United States Patent [19]

Bowden et al.

[11] Patent Number: 4,941,844

[45] Date of Patent: Jul. 17, 1990

[54] ELECTRICAL CONNECTOR

[75] Inventors: Wesley E. Bowden; Michael D. Swan, both of Emporia, Kans.

[73] Assignee: Hopkins Manufacturing Corporation, Emporia, Kans.

[21] Appl. No.: 258,021

[22] Filed: Oct. 14, 1988

[51] Int. Cl.[5] ..... H01R 4/24

[52] U.S. Cl. ..... 439/425; 439/35; 439/391; 439/417

[58] Field of Search ..... 439/389–419, 439/425, 426, 427, 736, 503, 505, 506, 34, 35

[56] References Cited

U.S. PATENT DOCUMENTS

| | | | |
|---|---|---|---|
| 2,647,246 | 7/1953 | Gilbert | 439/419 |
| 3,594,681 | 7/1971 | Weiss | 439/736 |
| 3,667,101 | 6/1972 | Kloth | 439/505 |
| 4,118,095 | 10/1978 | Berglund et al. | 439/403 |
| 4,270,830 | 6/1981 | Brenner | 439/425 |
| 4,280,062 | 7/1981 | Miller et al. | 439/505 |

FOREIGN PATENT DOCUMENTS

| | | | |
|---|---|---|---|
| 506443 | 11/1951 | Belgium | 439/418 |
| 1136528 | 5/1957 | France | 439/418 |

*Primary Examiner*—David Pirlot
*Attorney, Agent, or Firm*—Calfee, Halter & Griswold

[57] ABSTRACT

An electrical connector for providing an insulation displaced connection between first and second insulated electrical wires includes a base and a cap. The base includes a body having at least one groove and a first electrical wire partially embedded in the body. A terminal pin on the end of the first wire extends into and is partially exposed within that groove. A second insulated wire is positioned in and extends through the groove, and the cap is positioned around part of that second wire adjacent the body. The cap is then matingly slid along the base, with a cam surface on the cap slidingly contacting the second wire to force that wire into an insulation displaced connection with the terminal pin on the first wire. When the cap is fully received on the base, the electrical connection is complete without any hand tools being used. The base may have plural grooves and the cap may have plural camming surfaces aligned therewith to allow plural electrical connections to be made by assembling the cap onto the base.

6 Claims, 2 Drawing Sheets

ELECTRICAL CONNECTOR

FIELD OF THE INVENTION

The present invention relates to an electrical connector to make at least one electrically displaced electrical connection, in general and to an electrical connector particularly adapted for manually making an electrical connection for a trailer lighting system without tools, in particular.

BACKGROUND OF THE INVENTION

Electrical connectors having two principal components are known in the art. Reference may be had, for example, to Abbott U.S. Pat. No. 2,719,957; Walter U.S. Pat. No. 2,159,064 and Duffield U.S. Pat. No. 3,217,286.

The Abbott patent has two pins with sharpened points to make insulation displaced electrical connections with wires positioned in the connector body. These connections are made by pressing the wires onto the pins. A cover is then screwed onto the body to enclose the wires and provide a stress relief function.

In Walter, the electrical wires are received in grooves provided in the upper surface of a base member. Metallic prongs extend upwardly into at least a portion of the body grooves. A cap is then secured to the body with drive shoulders thereon engaging the wires in the grooves to force the same into insulation displaced electrical connections with the metallic prongs extending into the grooves.

The Duffield patent discloses a base member having grooves therein to receive electrical wires. Metal spikes respectively extend into and are exposed within those grooves. A cap is then screwed onto the body to bring a locking bar into engagement with the wires to drive the same into an insulation displaced electrical connection on the spikes.

Electrical connectors have also been developed which employ a wedging principal to obtain an insulation displaced electrical connection. Reference may be had, for example, to Hughes U.S. Pat. No. 4,152,686 and Denkmann U.S. Pat. No. 4,650,269.

The Hughes patent discloses an insulating body having a cavity therein to receive the ends of insulated wires of small diameter. The cavity also receives a terminal assembly including a contact arm and a wedge arm. The wedge arm is moved relative to the contact arm to bend the contact arm toward the wire to clamp the wire between the contact arm and the cavity wall to form an insulation displaced connection.

The Denkmann patent discloses a modular plug connector for a telephone type installation. A metallic terminal is slid into a terminal receiving slot in a dialectric housing. The terminal receiving slot has cam surfaces along the opposite walls thereof to force tangs on the metallic terminal into an insulation displaced connection with the wire in the slot.

Electrical connectors have also been used to provide an electrical connection between the lighting system of a towing vehicle and the lighting system of the towed vehicle. For example, Safford U.S. Pat. No. 2,981,921 discloses connectors for electrically coupling branch wires to insulated current conducting vehicle wires. The branch wires in Safford extend from the vehicle wiring connection, made by the connectors, to the trailer. Safford's connector includes a base member, a cap and a main conductor plate having prongs thereon sandwiched therebetween. The cap is screwed onto the base with a flange thereon forcing the received wire into an insulation displaced electrical connection on those prongs.

Reference may also be had to copending U.S. patent application Ser. No. 116,471, filed on Nov. 3, 1987 and assigned to the assignee of the present invention. Such patent application discloses a trailer light connection system including a two part connector having a cap screwed onto a body member to force wires into an insulation displaced connection with exposed terminal pins in grooves on the body.

SUMMARY OF THE INVENTION

The principal object of the present invention is to provide an electrical connector that may be quickly and reliably installed without any tools being required.

It is another object of the present invention to provide an electrical connector having a base member and a cap member, with relative sliding movement therebetween providing an insulation displaced electrical connection. For this purpose, the base has at least one groove with a terminal pin exposed therein for receiving a wire. The cap member has at least one camming ramp aligned with the groove body to provide a camming force on the wire as the body is being received in the cap cavity by relative sliding movement therebetween.

It is still another object of the present invention to provide plural insulation displaced electrical connections by axially sliding a cap relative to a base to position the base within the cap. For this purpose, axially staggered camming ramps may be provided on the cap sequentially to force wires in alignment therewith into insulation displaced connections with terminal pins extending upwardly into grooves on the mating body portion.

It is yet another object of the present invention to provide two part electrical connectors on the ends of wires leading from a modular plug of a split wire connector extension. The two part connectors on the split wire connector extension are adapted to provide insulation displaced connections with wires of the lighting system of a towing vehicle, without any hand tools being required for installation.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DETAILED DESCRIPTION OF THE DRAWINGS

DETAILED DESCRIPTION OF THE PREFERRED EMBODIMENTS

Figure 1:
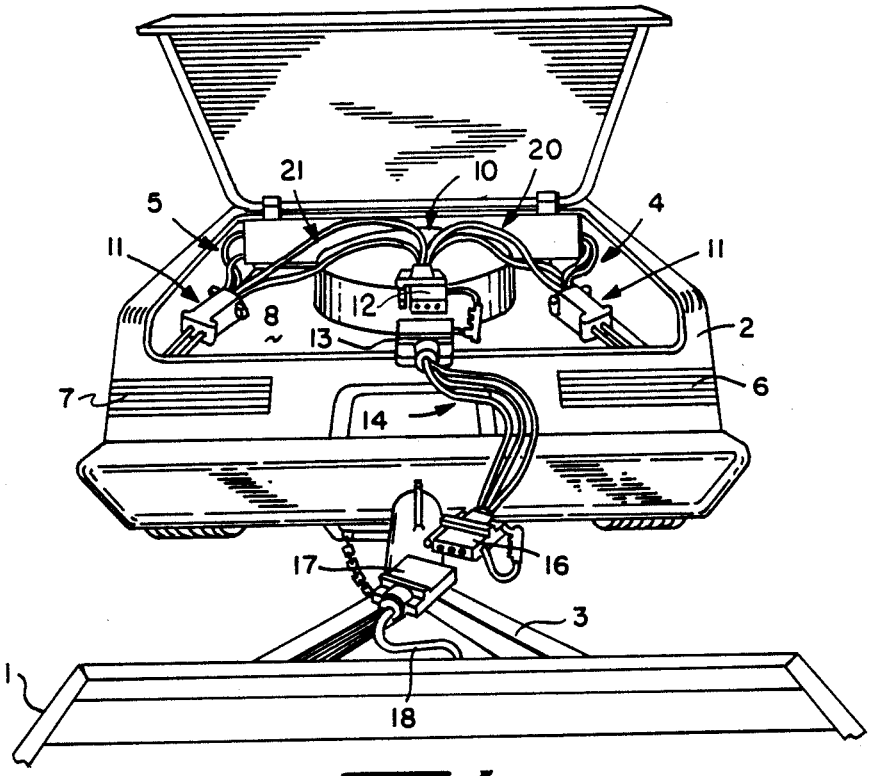
FIG. 1 is a perspective view of a trailer light connection system incorporating a two part electrical connector according to the present invention.

Turning now in more detail to the drawings and initially to FIG. 1, a trailer 1 is mechanically removably connected to a towing vehicle 2 by means of a trailer yoke 3. The electrical wiring system for the rear lights of the towing vehicle may be readily coupled to the electrical lighting system of the trailer by a trailer light connection system. Although a car is illustrated as being the towing vehicle, it will be appreciated that the trailer light connection system and the electrical connectors disclosed herein may be used with any and all types of towing vehicles including, for example, trucks and vans. It will be further appreciated that the electrical connector of the present invention can be used in any environment or application requiring an electrical branch line from a main line and that the trailer lighting application with two connections being made by each connector is disclosed herein for exemplary purposes only.

In the trailer lighting application embodiment, the insulated electrical wires of the car, indicated generally at 4 and 5 for the right and left tail lights 6 and 7, respectively, run along the right and left hand sides of a trunk 8. The respective electrical connections are made to these vehicle wires by a split wire connector extension, indicated generally at 10.

As will be described in more detail hereinafter, the split wire connector extension 10 is electrically connected to the vehicle wires 4 and 5 by the two part electrical connectors of the present invention, indicated generally at 11. The split wire connector extension 10 includes a modular plug 12 at the other end thereof selectively connected to a complementary mating plug 13 at one end of a trailer wiring harness, indicated generally at 14. The other or rear end of the trailer wiring harness 14 has a plug 16 selectively coupled to a mating plug 17 on the trailer light lighting system 18. The rear end of the trailer wiring harness may include other terminal forms compatible for electrical and mechanical coupling with the terminal form on the trailer lighting system 18. When the split wire extension 10, wiring harness 14 and trailer lighting system 18 are plugged together, the electrical circuit between the car and trailer is complete.

Figure 2:
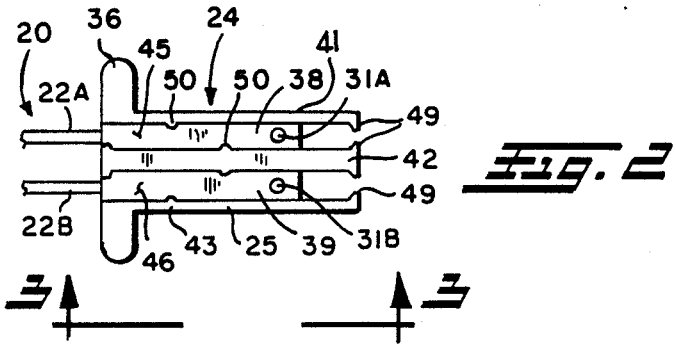
FIG. 2 is a plan view of the base member of the two-part electrical connector.
Figure 3:
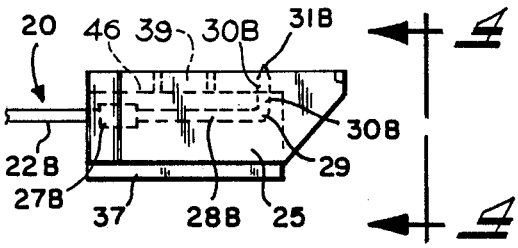
FIG. 3 is a side elevation of the base member taken generally along the plane 3—3 of FIG. 2.
Figure 4:
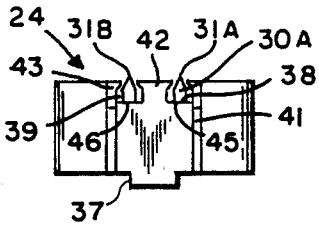
FIG. 4 is an end view of the base member taken generally along the plane 4—4 in FIG. 3.

The split wire connector extension 10, for two wires on each side of the towing vehicle lighting system, includes two separate or split pairs 20 and 21 of insulated wires. Turning now to FIG. 2 and using the right split pair 20 of insulated wires for exemplary description purposes, the first insulated lead wire 22A of pair 20 may be color coded for identification purposes and is operatively adapted for the right turn signal function. The second insulated lead wire 22B of the first pair may also be color coded in a different color for identification purposes and is operatively adapted for the right tail marker function. The pair of wires 22A and 22B have their respective forward ends embedded in and mounted to a connector base member, indicated generally at 24, of the two part electrical connector 11.

This base member includes a body 25 formed around the termination assemblies of the wires. The termination assemblies on the forward end of each wire 22A and 22B within body 25 are essentially identical. For ease of description, the termination assembly for wire 22B will be described, with letter suffixes being used to identify like parts for the other wire termination assemblies.

In assembling the termination, the insulation surrounding the conductor 22B at the leading or forward end of the wire is peeled back to expose the conductor. A split ring metal sleeve 27B is positioned partially to receive in its bore the end of the exposed conductor. A conductive terminal pin 28B has its flat end inserted into the opposite end of the bore of split ring sleeve 27B. Preferably, the exposed conductor end and flat pin end are brought into abutment with one another, with the bore of the split ring splice sleeve being slightly larger in diameter than the exposed conductor and pin. The split ring sleeve 27B is then radially contracted by crimping to splice the wire 22B, sleeve 27B and pin 28B into an end to end mechanical and electrical connection. The distal end of terminal pin 28B is bent at 29 to form contact portion 30B at right angles to the main portion of pin 28B. Contact portion 30B has a sharpened conical point 31B at its end. After each wire has its end termination assembled, the body 25 can be molded around the wire terminations.

For example, to make the base member 24, the wires 22A and 22B with their respective assembled sleeves and pins are held in a fixture in parallel relationship to one another within a mold (not shown). A plastic nonconductive material, preferably black ABS plastic or polypropylene, is then molded around the wire ends, sleeves and part of the pins to form connector body 25.

The connector body 25, as molded, includes an end hand grip 36 for manual manipulation, a central alignment rib 37 on the bottom surface for assembly purposes and two parallel grooves 38 and 39 on the top surface thereof for electrical connection purposes. The grooves 38 and 39 axially extend from one end of the body to the other and are formed in part by walls or partions extending upwardly from the main part of body 25. To this end, the body 25 includes adjacent its top surface a first sidewall 41, intermediate wall 42 and second sidewall 43. The groove 38 is cooperatively defined by first sidewall 41, base wall 45 and intermediate wall 42. Second groove 39 is cooperatively defined and formed by intermediate wall 42, base wall 46 and second sidewall 43.

First sidewall 41, intermediate wall 42 and second sidewall 43 extend in cantilevered relationship from one end of body 25. The forward upper ends of the cantilevered wall extensions may be provided with inwardly extending projections or shoulders 49 to provide a partially restricted throat at the ends of grooves 38 and 39. The walls 41, 42 and 43 may also be provided with axially spaced shoulders 50 extending into grooves 38 and 39, as illustrated, to restrict the width of the same. Shoulders 49 and 50 assist in holding the car wires to be connected within the grooves during installation as will be described in more detail hereinafter.

The contact portions 30A and 30B of pins 28A and 28B, respectively, extend upwardly into and are exposed within the grooves 38 and 39. The exposed contact portions with conical points thereon provide the electrical connection required with the car wires when the cap member of the electrical connector 11 is assembled on the base member 24 of the electrical connector 11.

Figure 5:
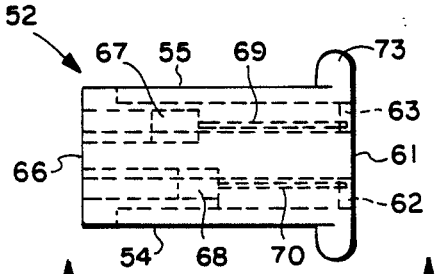
FIG. 5 is a plan view of the cap member of the two-part electrical connector, with the camming surfaces and pin relief channels being shown in hidden lines.
Figure 7:
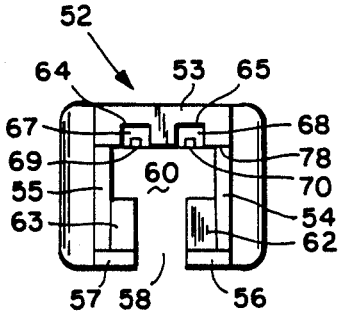
FIG. 7 is an end view of the cap member taken generally along the plane 7—7 in FIG. 6.
Figure 6:
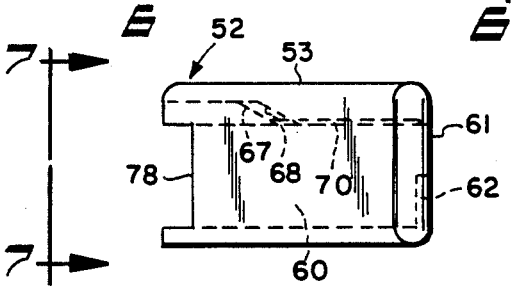
FIG. 6 is a side elevation of the cap member taken generally along the plane 6—6 in FIG. 5.

Turning to FIGS. 5 through 7, the cap member, indicated generally at 52, includes a body of non-conductive material, such as molded ABS or polypropylene plastic. The cap 52 includes a top wall 53, sidewalls 54 and 55, and inwardly facing flanges 56 and 57 at the bottom of the sidewalls 54 and 55. The flanges 56 and 57 cooperatively define a slot 58 therebetween. The slot 58 axially extends from one end of the cap 52 to the other. The top wall 53, sidewalls 54 and 55 and bottom opposing flanges 56 and 57 cooperatively define therebetween a cavity 60 which extends axially through the cap 52. The cavity opening at the back end 61 of the cap 52 may be restricted by stop members 62 and 63 being integrally formed on the rear ends of the sidewalls 54 and 55.

The top wall 53 of cap 52 has parallel camming grooves 64 and 65 formed in the surface thereof facing cavity 60 beginning at the front end 66 of the cap 52. The width of the parallel camming grooves 64 and 65 and the spacing therebetween are substantially equal to the width and spacing of the grooves 38 and 39 on body 25.

The camming groove 64 has an inclined camming ramp 67 therein leading to the inside surface of top wall 53. The camming groove 65 includes an inclined camming ramp 68 leading to the internal surface of top wall 53. The respective inclined camming ramps 67 and 68 are axially staggered relative to one another, as best shown in FIGS. 5 and 6, to reduce the force required to assemble the electrical connection, as will be discussed in more detail hereinafter. Pin relief channels 69 and 70 are respectively provided from the blind ends of camming grooves 64 and 65 to the back end 61 of the cap 52. The cap 52 may be provided with a laterally extending hand grip 73 to assist the installer in making the electrical connection.

Figure 8A:
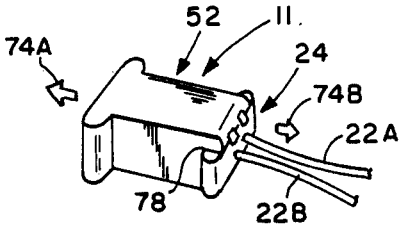
FIGS. 8A through 8G are perspective views of the electrical connector showing the operational sequence of making the insulation displaced electrical connections.

Although the assembly and operation of the electrical connector 11 are believed to be apparent from the above, a brief description of the assembly is hereinafter provided in the context of FIGS. 8A through 8G for purposes of completeness. In FIG. 8A, the electrical connector 11 is shown with the cap 52 positioned on the base 24 prior to an insulation displaced electrical connection being made with two other wires. The electrical connector 11 is thus illustrated as it would be purchased by the installer, with wires 22A and 22B in the exemplary application being part of the split wire extension 10 illustrated in FIG. 1.

To initiate the assembly process, the cap 52 is axially separated from the base 24 by relative sliding movement therebetween caused by pulling the respective parts away from one another as indicated by oppositely directed arrows 74A and 74B. Hand grip 36 on base member 24 and hand grip 73 on cap 52 may be used by the installer for oppositely pulling the respective parts. FIG. 8C illustrates the cap 52 being totally removed from the base member 24 to expose parallel grooves 38 and 39 on the top surface of body 25.

Figure 8D:
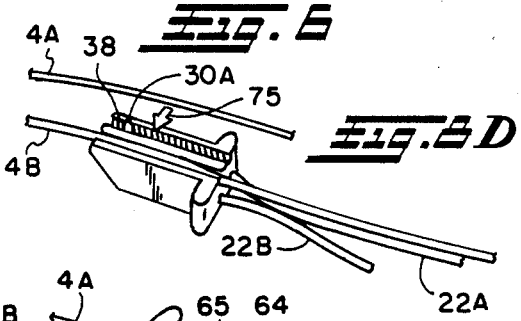
Figure 8B:
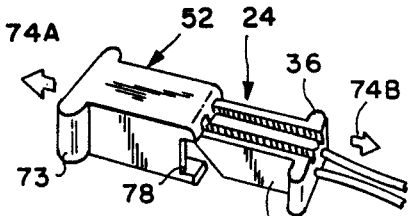

As best shown in FIG. 8D, the main electrical wires on one side of the vehicle lighting system are then respectively inserted into the appropriate grooves on the base member 24. To this end, indicia (not shown) can be provided on the body 25 of base member 24 to indicate the respective functions of wires 22A and 22B, respectively, of the split wire extension. For example, the indicia on body 25 could read "right turn" adjacent to groove 38 aligned with wire 22A and "tail marker" adjacent groove 39 aligned with wire 22B. The wires of the towing vehicle having these functions would then be manually positioned in the appropriate indicated groove 38 or 39.

A voltage tester may be provided as part of the trailer light connection kit to assist in identifying the electrical functions of the respective wires of the towing vehicle. For this purpose, the vehicle light function is manually initiated, such as turning on the right turn signal, and the vehicle wires on the right side of the vehicle trunk are then tested by the voltage tester to determine which one of the wires has a voltage applied thereto for performing the right turn function. When thus identified, the insulated wire 4A of the towing vehicle is inserted into the groove 38 for that function as indicated by the arrow 75. The same procedure is followed with respect to insulated wire 4B of the vehicle being inserted into the appropriate groove 39 in body 25 as illustrated in FIG. 8D.

When insulated wires 4A and 4B of the towing vehicle's wiring circuit have been respectively inserted in grooves 38 and 39 of base member 24, the outer diameter of the insulative coating on these wires comes into contact with the points 31A and 31B on the exposed contact portions 30A and 30B of the terminal pins. The wires 4A and 4B are held in place within the grooves of body 24 by being frictionally embraced by the sidewalls of the grooves and by the shoulders 49 and 50 axially spaced along the grooves. In this regard, those shoulders respectively contact the outer diameters of the wires to hold the same in proper position with respect to the body member 24 for assembling the cap 52 thereon to complete the insulation displaced electrical connection.

Figure 8E:
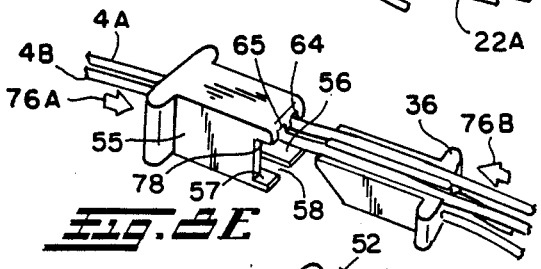
Figure 8F:
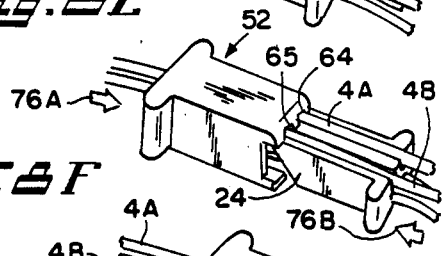
Figure 8C:
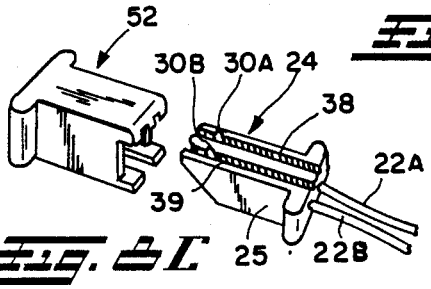
Figure 8G:
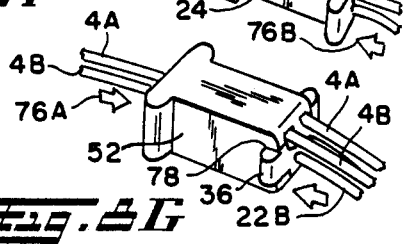

As shown in FIG. 8E, to initiate such assembly, vehicle wires 4A and 4B of the vehicle wiring circuit are positioned in and extend through the cavity 60 of cap member 52. In order to accomplish such positioning, the wires 4A and 4B are passed through the body slot 58 and cavity 60 into respective axial alignment with camming grooves 64 and 65.

Cap 52 and base member 24 are then moved axially toward one another by the installer as indicated by the arrows 76A and 76B. The cap and base member are brought into proper mating axial alignment with one another by the alignment rib 37 on the base body 25 being received within the cap slot 58.

With rib 37 in slot 58, the grooves 38 and 39 on body 25 are in axial alignment with camming grooves 64 and 65 on cap 52. As the oppositely directed assembly forces 76A and 76B are continued, the body 25 of the base member is received in the cavity 60 of the cap member. The dimensions of the body 25 are selected substantially to conform with the outer dimensions of the cavity 60 in body member 52. With such conformance, a sliding frictional fit is provided between the body member 24 and the cap member 52.

The cap and body member are axially moved relatively toward one another until the leading end of the base member 24 contacts the stop members 62 and 63 at the rear end 61 of the cap member 52. Such stop members 62 and 63 limit further relative movement toward one another to complete the assembly of the base and cap member. The sidewalls 54 and 55 of cap 52 have cutouts 78 formed therein to receive hand grip 36 on the base 24 at the end of the press fit assembly process, thereby to provide a compact connector with the electrical connections being substantially enclosed therewithin to provide protection from environmental contaminants and conditions. The insulation displaced electrical connections are made by and during the relative sliding movement between the cap and body.

In this regard, as the cap and base member are advanced toward one another, the wire 4A initially comes into contact with camming ramp 67. The axial movement of camming ramp 67 along the outer diameter of the wire 4A forces the same downwardly toward the body 25 of base member 24. The wire 4A is thus positively directed against the upstanding contact portion 30A of the terminal pin in the groove to force the contact pin portion with its sharpened point through the insulation layer of the wire into contact with the conductor therein. As the relative sliding movement is continued, camming ramp 68 contacts wire 4B to force the same downwardly onto the upstanding portion 30B of terminal pin 28B. The upstanding contact portion 30B with sharpened point 31B penetrates the insulation layer of wire 4B allowing contact to be made with the central conductor. The camming ramps 67 and 68 in the respective camming grooves are axially staggered so that the insulation displaced electrical connections are sequentially made. This reduces the amount of force required to bring the cap and base members into mated relationship with one another.

The pointed ends 31A and 31B of the terminal pin may extend through the conductor and insulation layer when assembled and thus be partially exposed on the upper end thereof. To accommodate this possibility, the relief channels 69 and 70 in the top wall 53 of the cap are adapted to receive the pointed ends to avoid interference to the sliding movement.

The connector 11 of the present invention also allows the insulation displaced electrical connections to be easily disassembled, if desired, without any tools being required. For this purpose, the cap would be disassembled from the body by manually applying oppositely directed relative forces thereon in the directions indicated by arrows 74A and 74B. With the cap removed, wires 4A and 4B in grooves 38 and 39 of body 25 are fully exposed. The wires 4A and 4B can then be pulled out of their respective body grooves to break the respective electrical connections with the terminal pins.

It will be apparent from the foregoing that changes may be made in the details of construction and configuration without departing from the spirit of the invention as defined in the following claims. For example, the body could have one groove with one terminal pin and the cap could have one camming groove and ramp to produce a single insulation displaced connection by assembling the cap on the body. Similarly, the base member and cap member could have any number of cooperating grooves and camming ramps in excess of two to complete a plurality of insulation displaced electrical connections at the same time. The camming ramps in such embodiment would be axially staggered relative to one another to minimize the assembly force required to complete the connection.

We claim:

1. An electrical connector comprising:

a base having a body and a first insulated electrical wire extending to the body and having one of its ends partially embedded therein, the body having an alignment rib axially extending outwardly therefrom at one end thereof, and including at least one camming groove extending therethrough along a top surface thereof;

a terminal pin on the embedded end of the first wire at least partially extending into the groove;

a second insulated wire at least partially received in and extending through the groove to extend outwardly in opposite directions from both ends of the base body, with the terminal pin extending into the groove;

means to engage the second insulated wire received in the groove including the groove in the body having a cantilevered end section and having shoulders axially spaced therealong to assist in holding the second wire within the groove until electrical connection is made; and a cap having a top wall, two spaced sidewalls extending downwardly from the top wall, a first end adapted to slidingly receive the base body, a second end having a restricted opening therein through which the second wire can extend when the connection is made, and two bottom flanges extending inwardly toward one another from the sidewalls to form a bottom slot, wherein said top wall, sidewalls and bottom flanges of the cap cooperatively define a cavity therewithin selectively to receive the base body;

said cap having a camming ramp thereon and the camming groove extending axially along the top wall of the cap from the first end thereof to the camming ramp, the camming groove and ramp facing inwardly toward the cavity, the cap being adapted to slidingly receive the base body and to partially surround the second insulated wire during relative movement therebetween, with the camming ramp slidingly contacting the second insulated wire during relative movement therebetween to force the same into an insulation displaced connection with the terminal pin.

2. The electrical connector of claim 1 wherein the cap top wall has a pin relief groove axially extending from the end of the camming ramp to adjacent the second end of the cap, the pin relief groove being adapted to receive the end of the terminal pin if it extends through the second wire after the insulation displacement connection is made.

3. The electrical connector of claim 2 wherein the second wire is passed through the slot into the cavity of the cap, the alignment rib of the base body is received in the slot of the cap and the cap is axially slid onto the base body by relative movement therebetween until the hand grip on the base body engages stop meáns on the cap.

4. The electrical connector of claim 3 wherein the stop means on the cap are integrally formed on the sidewalls thereof.

5. The electrical connector of claim 1 wherein the base body has plural grooves and terminal pins respectively extend into each of the plural grooves and the cap has plural camming ramps respectively aligned with the grooves when the cap is assembled on the base body, whereby plural insulation displaced connections may be made simultaneously.

6. The electrical connector of claim 5 wherein the plural camming ramps are axially staggered relative to one another to minimize the force required to assemble the electrical connector.

* * * * *